United States Patent [19]

Frederking

[11] Patent Number: 4,723,886

[45] Date of Patent: Feb. 9, 1988

[54] METHOD AND APPARATUS FOR LOADING AND UNLOADING RAILROAD GONDOLA CARS

[76] Inventor: Larry E. Frederking, 3760 Emily Dr., Port Allen, La. 70767

[21] Appl. No.: 885,452

[22] Filed: Jul. 14, 1986

[51] Int. Cl.[4] ..... B65G 67/02

[52] U.S. Cl. ..... 414/339; 414/537; 414/786; 180/906

[58] Field of Search ..... 414/333, 339, 394, 395, 414/537, 786; 180/9.48, 906

[56] References Cited

U.S. PATENT DOCUMENTS

| | | | |
|---|---|---|---|
| 1,368,081 | 2/1921 | Webb | 414/394 X |
| 1,967,283 | 7/1934 | Brown | 180/906 X |
| 2,906,212 | 9/1959 | Hayes | 414/339 X |
| 3,570,689 | 3/1971 | Eaton | 414/394 X |
| 3,820,616 | 6/1974 | Juergens | 180/9.48 |
| 3,863,988 | 2/1975 | Bartels | 180/9.48 X |
| 4,099,635 | 7/1978 | Leonard et al. | 414/339 X |
| 4,128,180 | 12/1978 | Mellious | 414/339 |
| 4,431,074 | 2/1984 | Langerud | 180/9.48 |

*Primary Examiner*—Nancy J. Stodola
*Attorney, Agent, or Firm*—David L. Ray

[57] ABSTRACT

A method and apparatus for loading and unloading a railroad gondola car having spaced apart, parallel side walls with upper surfaces, the apparatus including a hydraulic excavator having a boom structure and material engaging device mounted on two tracks, the two tracks being movable inwardly and outwardly from the base of the hydraulic excavator to vary the distance between the tracks, each of the tracks having a lip connected thereto which extends downwardly adjacent to the upper surface of the parallel side walls of a railroad gondola car to prevent the hydraulic excavator from falling off the gondola car when the two tracks are resting on the side walls of the gondola car.

6 Claims, 3 Drawing Figures

METHOD AND APPARATUS FOR LOADING AND UNLOADING RAILROAD GONDOLA CARS

BACKGROUND OF THE INVENTION

1. Field of the Invention

The present invention relates to a method and apparatus for loading and unloading railroad cars having open tops. Such open top railroad cars are commonly referred to as gondola cars. More particularly, the present invention is related to a method and apparatus for unloading open top railroad cars utilizing a hydraulic excavator mounted on tracks. Even more particularly, the present invention relates to a method and apparatus for unloading open top railroad cars employing a hydraulic excavator mounted on tracks which is adapted to be placed upon top of an open top railroad car or gondola car.

2. Brief Description of the Prior Art

Open top railroad cars or gondola cars are commonly unloaded by large mobile cranes adjacent to the area in which products removed from the gondola cars are to be transferred or stored. Such cranes are commonly located at railroad depots or unloading yards. However, it is quite common for unloading operations to be conducted at a location at which there are no mobile cranes available for unloading such gondola cars. In such situations cranes or other unloading equipment must be transported to the site. When cranes or other unloading equipment are not available, material such as cross-ties and railroad ballast must be removed by manual labor or by methods employing devices specifically designed for unloading such materials. Manual unloading is very expensive compared to unloading by machine. However, most unloading equipment specifically designed for a gondola car or other open top railroad car is also very expensive and cannot be used for purposes other than unloading a gondola.

U.S. Pat. Nos. 4,175,902 and 4,190,394 disclose an apparatus and method, respectively, for loading and unloading railroad cars. The apparatus is a mobile, wheeled apparatus or tractor having front and rear wheels movable over the ground surface and including power actuated boom structures pivotally mounted at the respective front and rear ends of the tractor. The apparatus has rubber tires and does not have tracks thereon. The tractor includes brackets or feet for supportive engagement with the upper surfaces of the car side walls and is able to climb on top of a gondola car from a position on the ground adjacent to the end of a gondola car. In the method disclosed the tractor uses the front and rear booms to raise the tractor up to the top of the gondola. The tractor has outrigger arms with attachments thereon for engaging the top of the gondola car and a front boom structure with arm members for engaging the top of the gondola car. The wheels of the tractor do not engage the top of the gondola car.

The apparatus and method disclosed in U.S. Pat. Nos. 4,175,902 and 4,190,394 requires that the entire tractor to which the power actuated boom structures are connected must be hoisted off of its wheels and into the air by the boom structures while the operator is on the tractor operating the controls. The operator of the tractor is at great risk if the hydraulic power system of the tractor were to fail because the tractor could then fall to the ground if the failure occurred while the tractor was being lifted onto a railroad gondola car. Hydraulic system failure could occur if a hydraulic hose were to burst, and the operator could be injured and equipment damaged when the tractor falls to the ground. A highly skilled operator is required since front and rear boom structures and a winch must be operated simultaneously. Furthermore, the tractor could fall into the interior of the gondola car in the event of a hydraulic system failure after the tractor is positioned on top of the car. After the tractor first leaves the ground to climb onto the gondola car, the tractor is never again supported by the wheels until it is returned to the ground; while conducting unloading operations, the tractor is entirely supported high above the ground by hydraulic systems which are subject to failure.

It is an object of the present invention to provide a safe and inexpensive method and apparatus for loading and unloading a railroad car by enabling a hydraulic excavator having tracks thereon to be positioned at the top of a railroad gondola car for unloading and loading of the gondola car.

It is another object of the present invention to provide a safe and inexpensive method and apparatus for positioning a hydraulic excavator on top of a railroad gondola car to load and unload the gondola car whereby the hydraulic excavator can be driven along the top of the car on the tracks provided with the hydraulic excavator.

It is a further object of the present invention to provide a safe and inexpensive method and apparatus for loading and unloading a railroad gondola car by enabling a hydraulic excavator having tracks thereon to be positioned and driven on top of a railroad gondola car with the tracks of the hydraulic excavator being supported by the sidewalls of the gondola car.

SUMMARY OF THE INVENTION

In accordance with the present invention there is provided an apparatus for loading and unloading a railroad gondola car having spaced apart, parallel side walls with upper surfaces, the apparatus including a hydraulic excavator having a boom structure and material engaging device mounted on two tracks, the two tracks being movable inwardly and outwardly from the base of the hydraulic excavator to vary the distance between the tracks, each of the tracks having a lip at the outer edge thereof which extends downwardly outside the upper surface of the parallel side walls of a railroad gondola car to prevent the hydraulic excavator from falling off of the gondola car when the two tracks are resting on the side walls of the gondola car.

The method of the invention for loading and unloading a railroad gondola car having spaced apart, parallel side walls with upper surfaces includes providing a mobile, powered hydraulic excavator having a boom structure with a material engaging device mounted on two tracks, the two tracks being movable inwardly and outwardly from the base of the hydraulic excavator to vary the distance between the tracks, each of the tracks having a lip at the outer edge thereof which extends downwardly outside the upper surface of the parallel side walls of the gondola car to prevent the hydraulic excavator from falling off the gondola car when the two tracks are resting on the upper surface of the side walls of the gondola car, providing a ramp at one end of a gondola car, moving the hydraulic excavator over the ground surface and positioning the hydraulic excavator near the ramp, adjusting the distance between the two tracks to align the two tracks with the upper surfaces of the parallel side walls of said gondola car and to position the lip on each of the tracks on the outside of the parallel side walls of the gondola car, driving said hydraulic excavator up the ramp onto the upper surface of the parallel side walls of the gondola car, and operating the boom structure and material engaging device to engage and disengage material relative to said railroad car and swing same to or from the ground surface alongside said railroad car.

The present invention has the advantages of providing a safe and economical method and apparatus for loading and unloading a gondola car. The apparatus can be easily driven up a ramp onto the top of a gondola car and will not slide off the top of the car. Furthermore, the apparatus of the present invention can be easily tracked from one car to the other without the necessity of additional equipment or ramps being provided since the length of the tracks is sufficient to span the normal spacing between two adjacent connected gondola cars. Furthermore, since the distance between the tracks of the apparatus of the invention can be varied, the apparatus can be placed inside of a gondola car and the gondola car can be unloaded from the bottom of the car, if desired.

When the apparatus of the invention is no longer needed to load or unload the railroad gondola car, the apparatus can be utilized to perform other jobs typically performed by a hydraulic excavator mounted on tracks.

BRIEF DESCRIPTION OF THE DRAWINGS

The above advantages and other features of the invention will be apparent during the course of the detailed description and by reference to the following drawings in which.

DESCRIPTION OF THE PREFERRED EMBODIMENTS

Figure 1:
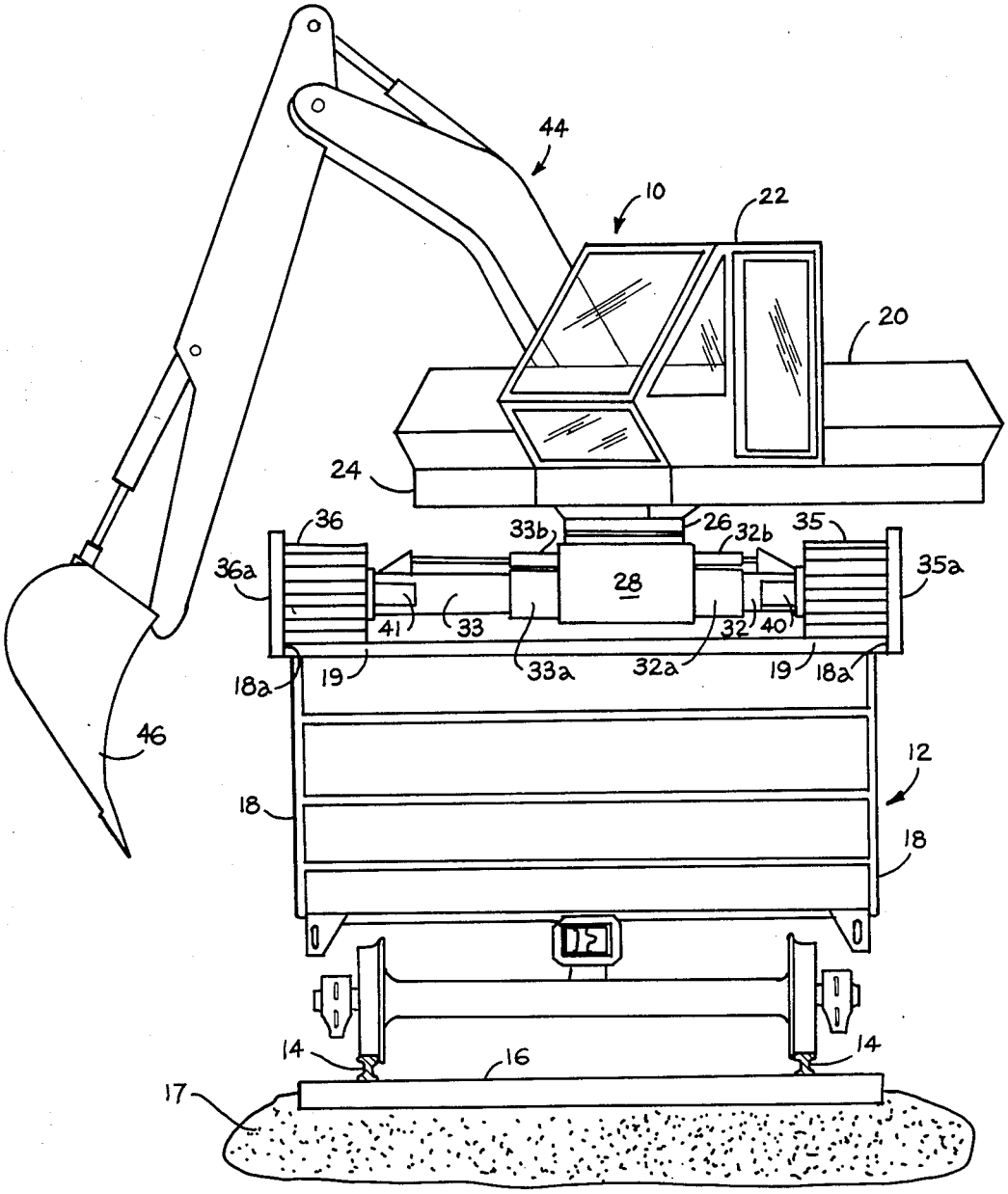
FIG. 1 is a front elevational view of the apparatus of the invention on top of a railroad gondola car.

Referring now to the drawings, the apparatus of the invention is generally indicated by the numeral 10. In general the apparatus is mobile and includes a track supported frame having a arm or boom pivotally mounted at one end for up and down swinging movements. The boom is an articulated boom for up and down movement and has a free end having a material engaging device pivotally connected thereto. The apparatus has an operator's cab and engine housing which rotates about a base to allow the articulated boom to be moved from side to side as the cab and engine housing turns. The base has two drive tracks connected thereto which preferably are adjustable inwardly and outwardly to vary the distance between the tracks by the use of hydraulic pistons. The drive tracks have legs connected thereto which are slidably received in sleeves connected to the base. The legs may have motors such as hydraulic motors connected thereto for driving the tracks. The tracks have lips on the outer edges thereof to prevent the apparatus from sliding off the gondola car.

Referring now to the invention in greater detail, the apparatus 10 includes an excavating machine generally referred to by those skilled in the art as a hydraulic excavator mounted on tracks which is of the type commonly used in construction and material moving operations. In FIG. 1, the apparatus 10 as shown in position for loading and unloading on a gondola car generally indicated by the numeral 12. Gondola car 12 is located on railroad tracks 14—14. The tracks 14—14 are mounted on cross ties 16 which rest on the ground 17. The apparatus 10 is used for loading and unloading an elongated gondola car 12 or open top tank car which includes spaced, parallel upright sidewalls 18 having an upper surface 19 on which the apparatus 10 rests.

The apparatus 10 includes an engine (not shown) or other power device located within housing 20, an operator cab 22 having a seat and suitable power and operator controls therein, and a frame 24 upon which operator cab 22 and housing 20 rests. Frame 24 has a support member 26 rigidly connected thereto which is generally circular in shape and is rotatably connected to base 28. Base 28 has four adjustable legs 31, 32, 33 and 34 connected thereto. The legs 31 and 32 are connected to track 35 and the legs 33 and 34 are connected to track 36. The legs 31–34 support base 28 and are in turn supported by tracks 35 and 36. Hydraulic motors 40 and 41 are located on legs 32 and 33, respectively, to drive tracks 35 and 36 as is well known to those skilled in the art. Leg 32 is slidably mounted in sleeve **32*a*, leg 33 is slidably mounted in sleeve 33*a*, leg 34 is slidably mounted in sleeve 34*a*, and leg 31 is slidably mounted in sleeve 31*a***.

A series of hydraulic cylinder and pistons assemblies are connected to base 28 and to each of the legs to move pairs of the legs inwardly and outwardly from the base 28 as desired. Hydraulic cylinder and piston assembly **32*b* is connected to leg 32 and base 28, hydraulic cylinder and piston assembly 33*b* is connected to leg 33 and base 28, hydraulic cylinder and piston assembly 34*b* is connected to 34 and base 28, and hydraulic cylinder and piston 31*b* is connected to leg 31 and base 28**.

Figure 3:
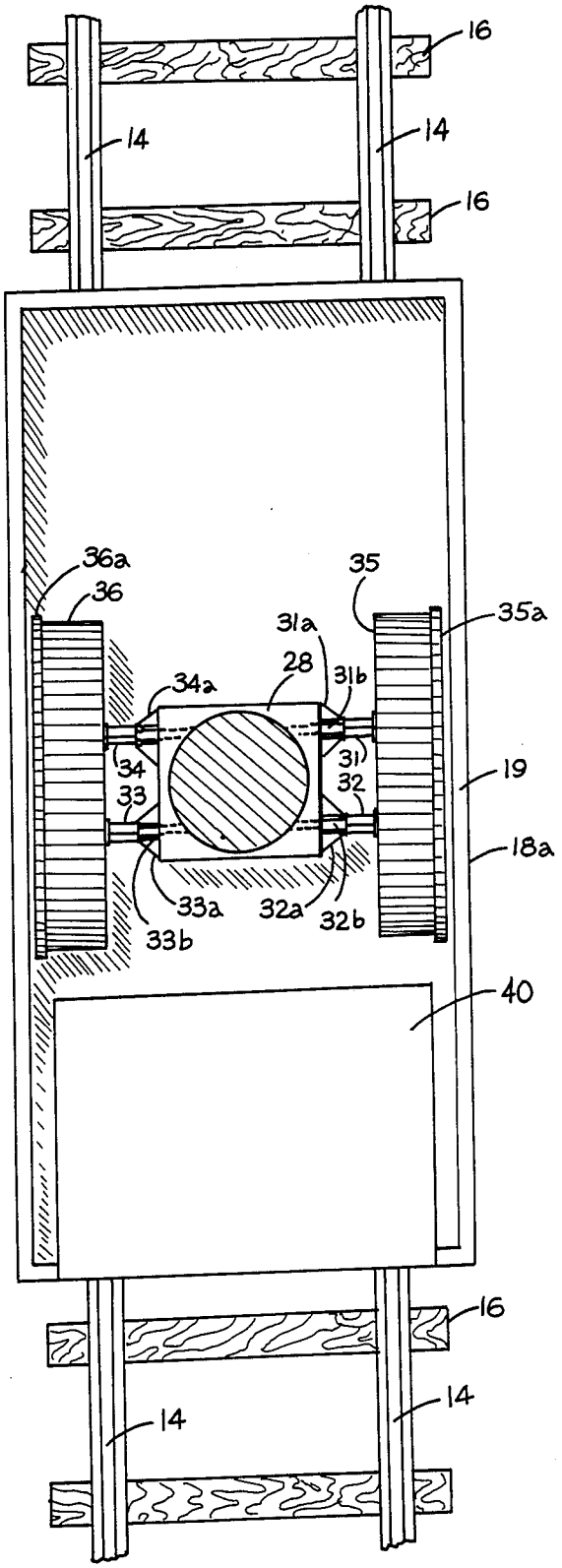
FIG. 3 is a top, partially sectional view of the apparatus of the invention shown inside of a gondola car.

Thus, to vary the distance between tracks 35 and 36 to enable apparatus 10 to rest on the upper surface 19 of gondola car 12 as shown in FIG. 1 or to rest on the bottom 13 of gondola car 12 as shown in FIG. 3, a pair of hydraulic cylinder and piston assemblies such as **33*b* and 34*b* shown in FIG. 1 can be extended to force track 36 further from base 28 than in track 35, or retracted as shown in FIG. 3 to allow apparatus 10 to rest on the bottom 13 of gondola car 12. If desired, only a single pair of hydraulic cylinder and piston assemblies, such as 33*b* and 34*b*, could be utilized to move only one track 36. Preferably, two pairs of hydraulic cylinder and piston assemblies are connected to apparatus 10 as shown in FIG. 3 to move both tracks 35 and 36** individually or in unison.

Connected to the outside edge of tracks 35 and 36 are lips **35*a* and 36*a* which are connected to the each of the individual slats on tracks 35 and 36 by any desired method such as bolting, welding, riveting or the like. Lips 35*a* and 36*a* prevent the tracks from slipping from the top of the gondola car. Lips 35*a* and 36*a* may be removed when the apparatus of the invention is not being used to unload gondola cars. If desired, lips 35*a* and 36*a* may be connected to the inside edge of tracks 35 and 36**.

Figure 2:
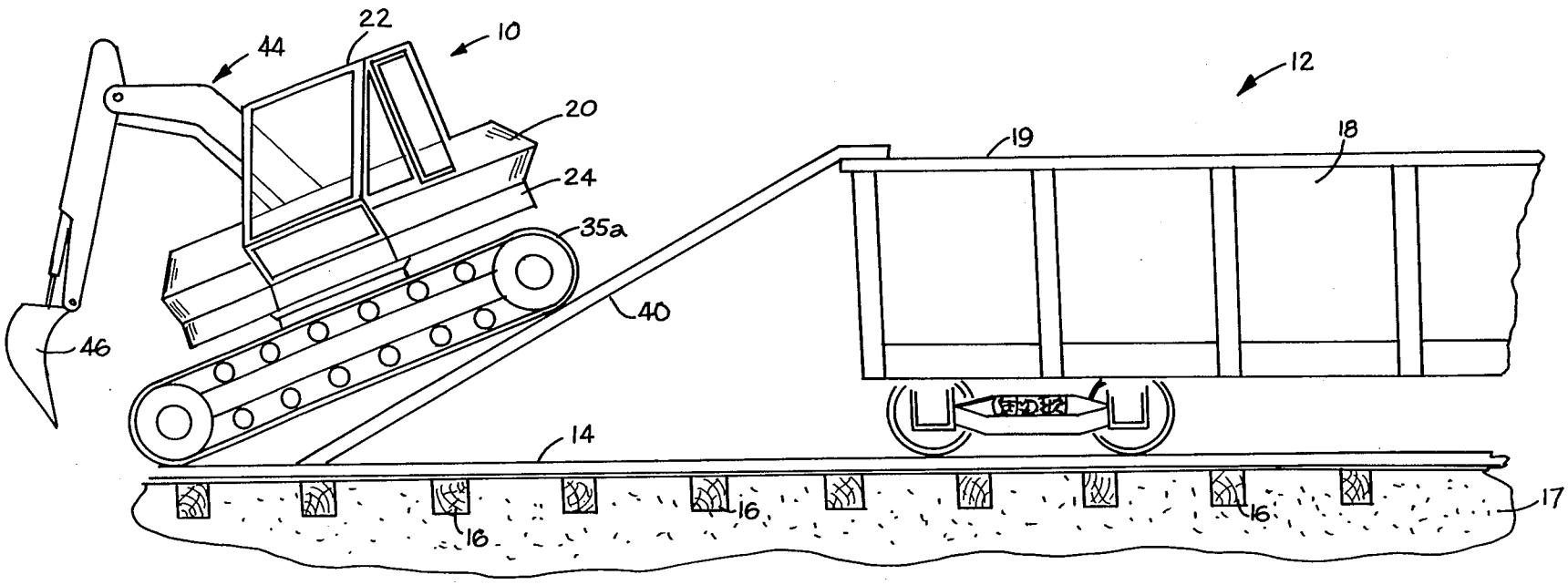
FIG. 2 is a side plan view of the apparatus of the invention traveling up a ramp toward the top of a gondola car.

As can be seen in FIG. 2, a ramp 40 of any conventional type may be be placed on the top of the gondola car 12 and the apparatus 10 may be driven up the ramp to the position shown in FIG. 1. The length of the tracks is sufficient to allow the apparatus 10 to move from one gondola car to an adjacent gondola car without the use of any additional ramps.

Prior to driving the apparatus 10 up ramp 40, the distance between tracks 35 and 36 is adjusted by the use of hydraulic cylinder and piston assemblies 31*b*, 32*b*, 33*b*, 34*b*, or either of cylinder and piston assembly pairs 31*b*–32*b*, or 33*b*–34*b*, to a distance for tracks 35 and 36 to fit on the upper surface 19 of gondola car 12 as shown in FIG. 1. Preferably, the distance between tracks 35 and 36 is adjusted to a distance such that lips 35*a* and 36*a* lie adjacent to the outer edge 18*a* of upper surface 19 to prevent apparatus 10 from falling off the top of gondola car 12.

If it is desired to place apparatus 10 inside gondola car 12 as shown in FIG. 3, a second ramp 40*a* can be placed in gondola car 12 adjacent to ramp 40 and the distance between tracks 35 and 36 is adjusted to a distance such that tracks 35 and 36 can be fitted inside side walls 18 of gondola car 12.

Material is loaded and unloaded from the gondola car by the conventional articulated hydraulically operated boom generally indicated by the numeral 44 having a bucket or other material handling device 46 connected thereto. The boom is turned from side to side by rotating frame 24 about base 28.

If desired, apparatus 10 may be placed on top of gondola car 12 by any means known in the art.

Although the preferred embodiments of the present invention have been disclosed and described in detail above, it should be understood that the invention is in no sense limited thereby, and its scope is to be determined by that of the following claims.

What is claimed is:

1. An apparatus for loading and unloading a railroad gondola car having spaced apart, parallel side walls with upper surfaces, the apparatus comprising:

a. a hydraulic excavator means for excavating, loading, and unloading materials, said hydraulic excavator means having a boom structure and a material engaging device rotatably mounted on base means for rotatably supporting said boom structure and said material engaging device, said base means being connected to two tracks for moving said hydraulic excavator means from one location to another, b. adjusting means for moving said tracks inwardly and outwardly to vary the distance between said tracks, said adjusting means comprising hydraulic cylinder and piston assembly means for selectively moving one or both of said two tracks toward, or away from, the other of said tracks, and c. lip means connected to each of said two tracks for preventing said hydraulic excavator means from falling off said gondola car when said two tracks are resting on said upper surfaces of said gondola car, said lip means being adapted to extend downwardly adjacent to the upper surface of said parallel side walls of said railroad gondola car when said hydraulic excavator means is located on top of said gondola car.

2. The apparatus of claim 1 wherein said hydraulic cylinder and piston assembly means comprises leg means connected to at least one of said track means for supporting said base means, said leg means being slidably received in sleeve means connected to said base means for slidably receiving said leg means and supporting said base means.

3. The apparatus of claim 2 wherein said sleeve means are rigidly connected to said base means for rotatably supporting said boom structure and material engaging device.

4. The apparatus of claim 3 wherein said leg means has motor means connected thereto for driving said tracks.

5. The apparatus of claim 4 wherein said motor means is a hydraulic motor.

6. A method for loading and unloading a railroad gondola car having spaced apart, parallel side walls with upper surfaces comprising:

a. providing a mobile, powered hydraulic excavator means rotatably mounted on two tracks having a boom structure with a material engaging device, said two tracks being movable inwardly and outwardly from the base of the hydraulic excavator to vary the distance between said two tracks, each of said tracks having a lip means connected to the outer edge thereof which extends downwardly outside the upper surface of said parallel side walls of said gondola car to prevent said hydraulic excavator means from falling off said gondola car when said two tracks are resting on said upper surface of said side walls of said gondola car, b. providing a ramp at one end of said gondola car, c. driving said hydraulic excavator on said tracks over the ground surface to position said hydraulic excavator near said ramp, d. adjusting the distance between said two tracks by moving said two tracks inwardly or outwardly to align said two tracks with the upper surfaces of said parallel side walls of said gondola car to position said lip means on each of said tracks on the outside of said parallel side walls of said gondola car when said hydraulic excavator means is located on top of said gondola car, e. driving said hydraulic excavator means up said ramp onto said upper surfaces of said parallel side walls of said gondola car, and f. operating said boom structure and said material engaging device to engage and disengage material relative to said railroad gondola car and swing same to or from the ground surface alongside said railroad car to and from said railroad gondola car.

* * * * *